US009921525B2

(12) United States Patent
Mitsumata et al.

(10) Patent No.: US 9,921,525 B2
(45) Date of Patent: Mar. 20, 2018

(54) IMAGE FORMING APPARATUS

(71) Applicant: CANON KABUSHIKI KAISHA, Tokyo (JP)

(72) Inventors: Akinori Mitsumata, Tokyo (JP); Takeo Kawanami, Fujisawa (JP); Noritomo Yamaguchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/163,136

(22) Filed: May 24, 2016

(65) Prior Publication Data

US 2016/0349673 A1 Dec. 1, 2016

(30) Foreign Application Priority Data

May 28, 2015 (JP) ..... 2015-109182

(51) Int. Cl.
*G03G 15/16* (2006.01)

(52) U.S. Cl.
CPC ..... *G03G 15/1615* (2013.01)

(58) Field of Classification Search
CPC ..... G03G 15/0163; G03G 15/013; G03G 15/1089; G03G 15/0194; G03G 15/1605; G03G 15/1615; G03G 15/162; G03G 15/165; G03G 15/1685; G03G 2215/16; G03G 2215/1642
See application file for complete search history.

(56) References Cited

U.S. PATENT DOCUMENTS 5,985,499 A * 11/1999 Guth ..... B41J 2/45 399/231
6,349,192 B1 * 2/2002 Yoshino ..... G03G 15/0131 399/302
9,557,690 B2 * 1/2017 Hatano ..... G03G 15/1615
2005/0158085 A1 * 7/2005 Murakami ..... G03G 15/165 399/299
2007/0059054 A1 * 3/2007 Furukawa ..... G03G 21/168 399/302
2008/0152399 A1 * 6/2008 Umeda ..... G03G 15/0131 399/307
2008/0292338 A1 * 11/2008 Fujiwara ..... G03G 15/0131 399/44
2009/0317146 A1 * 12/2009 Ohtsuki ..... G03G 15/161 399/299
2011/0064464 A1 * 3/2011 Ju ..... G03G 15/161 399/121

(Continued)

FOREIGN PATENT DOCUMENTS

JP 06-80266 A 3/1994
JP 2007-322515 A 12/2007

(Continued)

*Primary Examiner* — Clayton E Laballe
*Assistant Examiner* — Ruifeng Pu
(74) *Attorney, Agent, or Firm* — Canon USA, Inc. I.P. Division

(57) ABSTRACT

A transfer device includes a rubbing member provided in contact with a transfer belt, a supporting member supporting the rubbing member, and a damping member configured to damp vibration of the transfer device. The damping member is fastened to the supporting member, and an end of the damping member in a width direction that is orthogonal to a direction of rotation of the transfer belt is a free end.

20 Claims, 18 Drawing Sheets

(56) References Cited

U.S. PATENT DOCUMENTS

2011/0188890 A1* 8/2011 Hoshino ..... G03G 15/16 399/121
2011/0211871 A1* 9/2011 Mori ..... G03G 15/1605 399/297
2011/0318048 A1* 12/2011 Yasumoto ..... G03G 15/161 399/101
2012/0045228 A1* 2/2012 Kobayashi ..... G03G 15/5054 399/40
2012/0045245 A1* 2/2012 Sakurai ..... G03G 15/1615 399/121
2012/0045256 A1* 2/2012 Sasaoka ..... G03G 15/5058 399/301
2012/0057908 A1* 3/2012 Meguro ..... F16H 7/0827 399/313
2012/0251193 A1* 10/2012 Ohashi ..... G03G 15/0189 399/299
2013/0164049 A1* 6/2013 Kawanami ..... G03G 15/16 399/302
2013/0216260 A1* 8/2013 Kogure ..... G03G 15/0131 399/121
2014/0147178 A1* 5/2014 Hosohara ..... G03G 15/1615 399/298
2014/0209437 A1* 7/2014 Hozumi ..... B41J 11/007 198/806
2014/0286686 A1* 9/2014 Taira ..... G03G 15/6529 399/361
2014/0334856 A1* 11/2014 Nakagaki ..... G03G 15/1615 399/302
2015/0027857 A1* 1/2015 Hazeki ..... B65G 15/64 198/806
2015/0346643 A1* 12/2015 Konishi ..... G03G 15/1685 399/121
2016/0054685 A1* 2/2016 Hazeki ..... G03G 15/1615 399/313
2016/0091835 A1* 3/2016 Murayama ..... G03G 15/1615 399/302
2016/0091837 A1* 3/2016 Morita ..... G03G 21/1647 399/298
2016/0103404 A1* 4/2016 Hasegawa ..... G03G 15/1605 399/313
2016/0170363 A1* 6/2016 Kogure ..... G03G 15/6558 399/316
2016/0216650 A1* 7/2016 Hatano ..... G03G 15/1615
2016/0259284 A1* 9/2016 Fujiwara ..... G03G 15/6558
2016/0266522 A1* 9/2016 Miyakoshi ..... G03G 21/1623
2016/0357129 A1* 12/2016 Kakehi ..... G03G 15/1605
2016/0370737 A1* 12/2016 Kakehi ..... G03G 15/1615

FOREIGN PATENT DOCUMENTS

JP 2008-203669 A 9/2008
JP 2011-248385 A 12/2011
JP 2015-087486 A 5/2015

* cited by examiner

IMAGE FORMING APPARATUS

BACKGROUND OF THE INVENTION

Field of the Invention

The present invention relates to an image forming apparatus, such as a copier, a printer, a facsimile, or a multifunction machine, configured to form an image on a sheet.

Description of the Related Art

Some related-art electrophotographic image forming apparatuses, such as a copier or a printer, employ intermediate transfer belts as transfer belts. In such an image forming apparatus employing an intermediate transfer belt, a full-color image is formed through a primary-transfer step and a secondary-transfer step.

In the primary-transfer step, a toner image formed on a surface of an electrophotographic photoconductive member is primarily transferred to the intermediate transfer belt. The primary-transfer step is performed for forming each of a plurality of toner images in different colors, whereby a combination of toner images in different colors is formed on the intermediate transfer belt. In the secondary-transfer step, the combination of toner images in different colors is transferred to a surface of a transfer material such as a piece of paper. The combination of toner images thus transferred to the transfer material is then fixed by a fixing device. Thus, a full-color image is obtained.

A transfer device included in such an image forming apparatus includes a transfer member in the form of a roller, a blade, a brush, or the like. The transfer member is a contact member that is provided in contact with the inner peripheral surface of the intermediate transfer belt at a position across from the photoconductive member.

In Japanese Patent Laid-Open No. 2011-248385, an image forming apparatus including a brush-type transfer member as a transfer device is disclosed. The brush-type transfer member according to Japanese Patent Laid-Open No. 2011-248385 includes a stainless-steel metal holder (a supporting member) that supports a brush thereon with the aid of two-sided adhesive tape. The brush include a plurality of conductive fibers. That is, the transfer member according to Japanese Patent Laid-Open No. 2011-248385 is disclosed as a brush-type rubbing member that is unrotatably in contact with the intermediate transfer belt and thus rubs the intermediate transfer belt.

Employing such a rubbing member as in Japanese Patent Laid-Open No. 2011-248385 generates a large frictional force between the rubbing member and the intermediate transfer belt and may lead to, for example, bending of the rubbing member or the supporting member or generation of noise due to vibration of the rubbing member or the supporting member caused by a stick-slip phenomenon or the like. Such a condition occurs not only in the case of the intermediate transfer belt but also in a case of a conveying belt that bears and conveys the transfer material and in a case of any other rubbing member that may vibrate by rubbing a moving object provided in the image forming apparatus.

SUMMARY OF THE INVENTION

The present invention provides a simple mechanism that damps the vibration of a supporting member due to a frictional force generated between a rubbing member and a rubbed member.

According to an aspect of the present invention, there is provided an image forming apparatus including an image bearing member configured to bear a toner image, a rotatable transfer belt to which the toner image on the image bearing member is transferred to a transfer material, and a transfer device provided in contact with the transfer belt and configured to transfer the toner image from the image bearing member to the transfer belt. The transfer device includes a rubbing member provided in contact with the transfer belt, a supporting member supporting the rubbing member, and a damping member configured to damp vibration of the transfer device. The damping member is fastened to the supporting member, and an end of the damping member in a width direction that is orthogonal to a direction of rotation of the transfer belt is a free end.

Further features of the present invention will become apparent from the following description of exemplary embodiments with reference to the attached drawings.

DESCRIPTION OF THE EMBODIMENTS

Referring to the attached drawings, embodiments of the present invention will now be described in detail. Dimensions, materials, shapes, relative arrangements, and other factors of elements described herein should be changed appropriately in accordance with the configuration and associated conditions of an apparatus to which the present invention is applied. Hence, the following embodiments do not limit the scope of the present invention thereto unless otherwise specified.

First Embodiment

Figure 1:
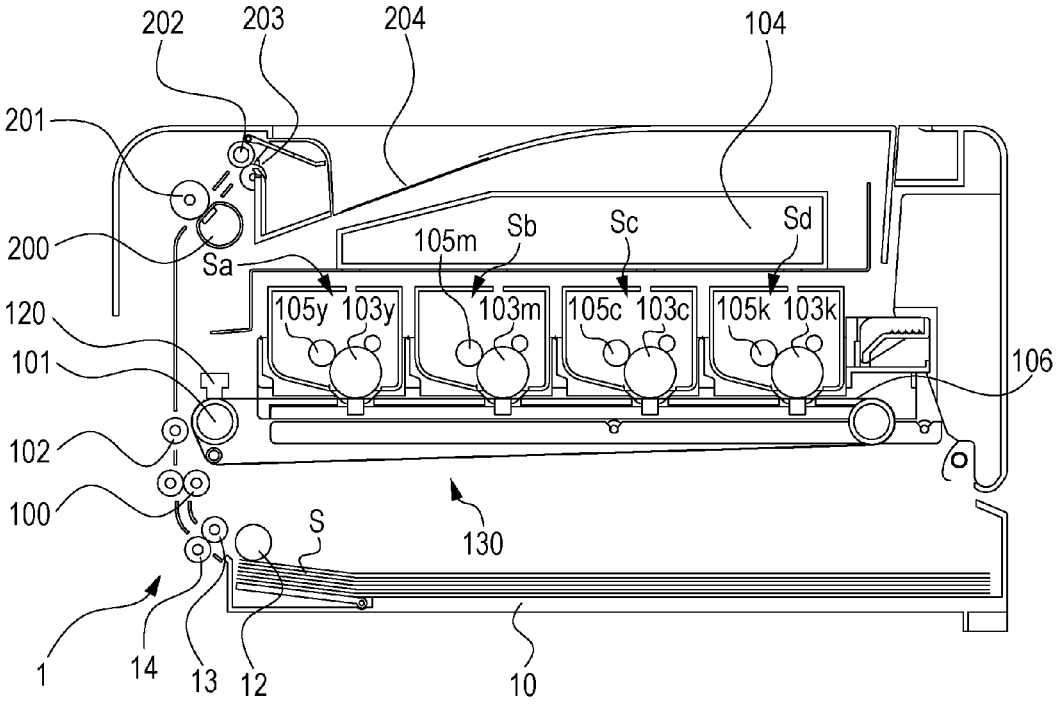
FIG. 1 is a schematic sectional view of an image forming apparatus according to a first embodiment of the present invention.

FIG. 1 is a schematic sectional view of an image forming apparatus 1 according to a first embodiment of the present invention. The image forming apparatus 1 according to the first embodiment is an electrophotographic full-color laser-beam printer. The image forming apparatus 1 electrophotographically forms an image on a transfer material, such as a recording sheet or an overhead-projector (OHP) sheet, in accordance with a signal transmitted to the image forming apparatus 1 from an external apparatus, such as a personal computer, communicably connected to the image forming apparatus 1.

In the image forming apparatus 1 according to the first embodiment illustrated in FIG. 1, surfaces of photoconductive drums (image bearing members) 103*y*, 103*m*, 103*c*, and 103*k* are charged by charging rollers 105*y*, 105*m*, 105*c*, and 105*k*, respectively. The charged surfaces of the photoconductive drums 103*y*, 103*m*, 103*c*, and 103*k* are exposed to light emitted from a laser scanner 104, serving as an exposure device, in accordance with image information, whereby electrostatic latent images are formed on the respective photoconductive drums 103*y*, 103*m*, 103*c*, and 103*k*. The electrostatic latent images are developed with yellow, magenta, cyan, and black toners by developing members 112*y*, 112*m*, 112*c*, and 112*k*, respectively, whereby toner images in the respective colors are formed. The toner images thus formed on the respective photoconductive drums 103*y*, 103*m*, 103*c*, and 103*k* are primarily transferred to an intermediate transfer belt 106, which is in the form of an endless transfer belt, in such a manner as to be superposed one on top of another.

Meanwhile, one of transfer materials S stacked in a cassette 10 is conveyed by a feed roller 12, a conveying roller 13, a separating roller 14, and a pair of registration rollers 100 to a nip (secondary-transfer part) defined between a secondary-transfer counter roller 101 and a secondary-transfer roller 102.

The transfer material S thus conveyed to the secondary-transfer part undergoes the secondary transfer, in which the toner images superposed on the intermediate transfer belt 106 are secondarily transferred to the transfer material S. The transfer material S now having the toner images is heated and pressed by a fixing device (including a fixing film 200 and a pressing roller 201), whereby the toner images on the transfer material S are fixed. The transfer material S now having the fixed toner images is discharged onto a discharge tray 204 by a discharge roller 202 and a discharge follower roller 203.

Residual toner particles on the surface of the intermediate transfer belt 106 that has undergone the secondary transfer are charged by a residual-toner-charging unit 120. In this step, the residual toner particles are charged by the residual-toner-charging unit 120 to a polarity opposite to the normal polarity and are then moved from the intermediate transfer belt 106 to the photoconductive drums 103*y*, 103*m*, 103*c*, and 103*k* at respective primary-transfer parts.

To form a full-color image, the above steps of charging, exposure, development, and primary transfer are performed in first to fourth stations Sa, Sb, Sc, and Sd in that order from the upstream side in a direction of rotation of the intermediate transfer belt 106. Thus, a full-color image that is composed of toner images having the four colors of yellow, magenta, cyan, and black and superposed one on top of another on the intermediate transfer belt 106 is formed on the transfer material S. To form a monochrome (mono-color) image, the steps of charging, exposure, development, and primary transfer are performed in any one of the first to fourth stations Sa, Sb, Sc, and Sd.

Figure 2:
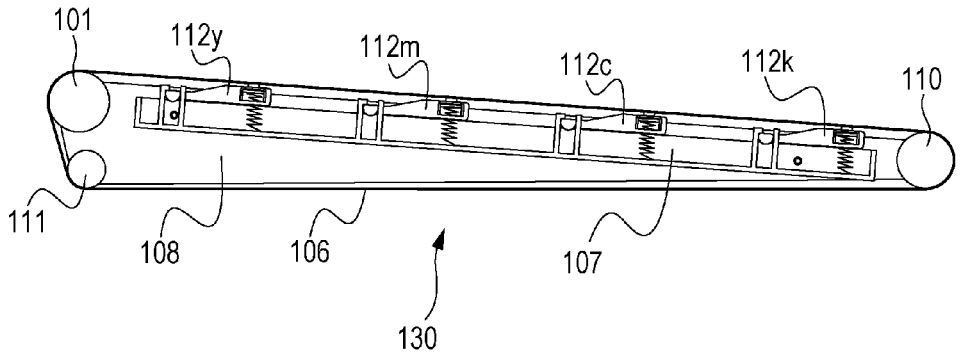
FIG. 2 is a schematic sectional view of an intermediate transfer unit according to the first embodiment.
Figure 3:
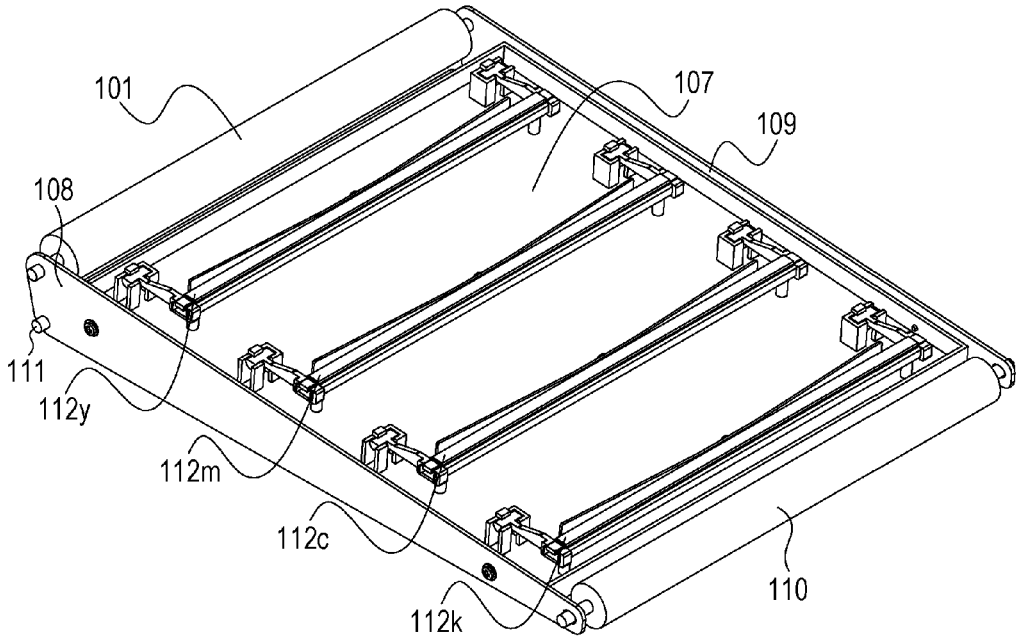
FIG. 3 is a schematic perspective view of the intermediate transfer unit.

Now, a configuration of an intermediate transfer unit 130 as a transfer unit will be described. FIG. 2 is a schematic sectional view of the intermediate transfer unit 130. FIG. 3 is a schematic perspective view of the intermediate transfer unit 130. The intermediate transfer unit 130 according to the first embodiment illustrated in FIGS. 2 and 3 is attachable to and detachable from the body of the image forming apparatus 1.

In the intermediate transfer unit 130, the intermediate transfer belt 106 having an endless shape and being rotatable is stretched around three stretching rollers: namely, the secondary-transfer counter roller 101, a tension roller 110, and an assist roller 111. The secondary-transfer counter roller 101, the tension roller 110, and the assist roller 111 are each rotatably supported by a left side plate 108 and a right side plate 109. The primary-transfer units 112*y*, 112*m*, 112*c*, and 112*k* are supported by a unit frame 107 at respective positions facing the respective photoconductive drums 103*y*, 103*m*, 103*c*, and 103*k*.

The tension roller 110 urges the intermediate transfer belt 106 from the inner side of the intermediate transfer belt 106 with a tension spring (not illustrated) and thus defines, with the aid of the assist roller 111, a belt surface along which the transfer material S is guided to the secondary-transfer part.

Figure 4:
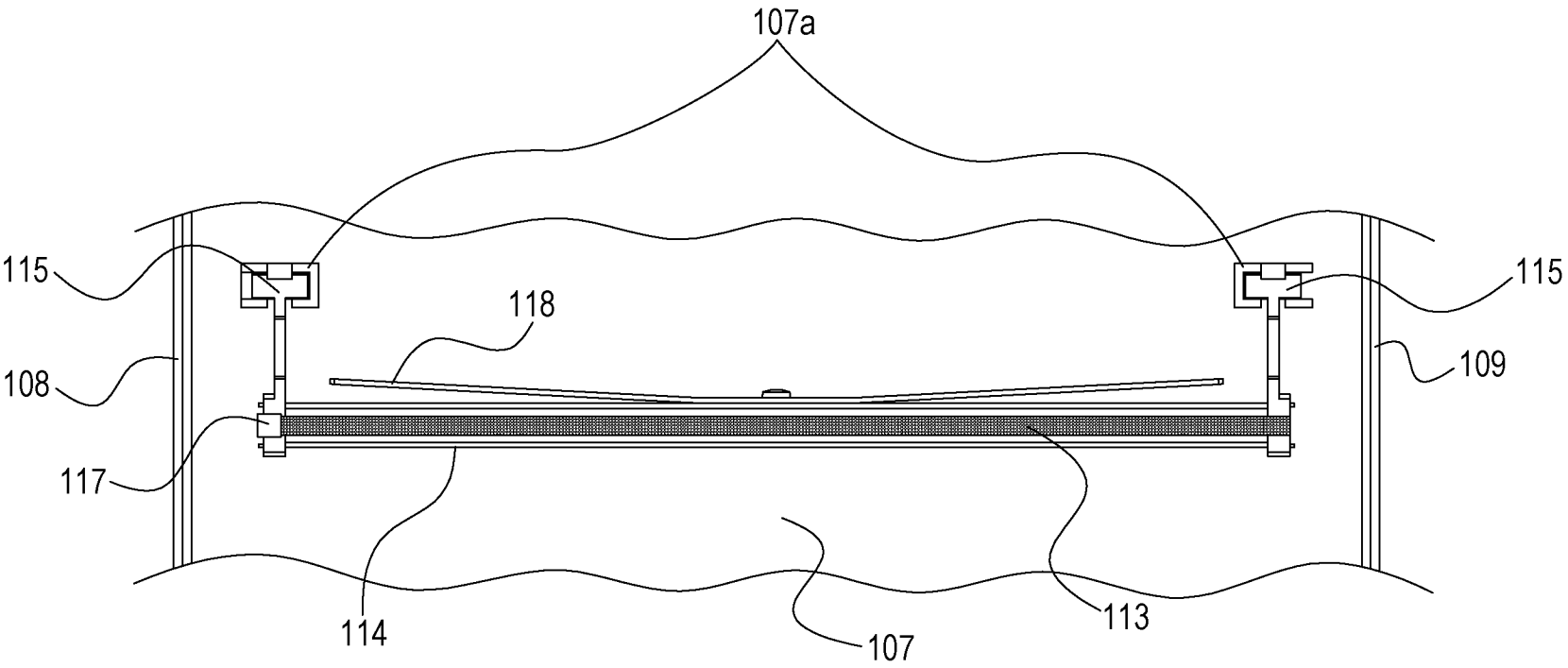
FIG. 4 is a schematic top view of a primary-transfer unit according to the first embodiment.
Figure 5:
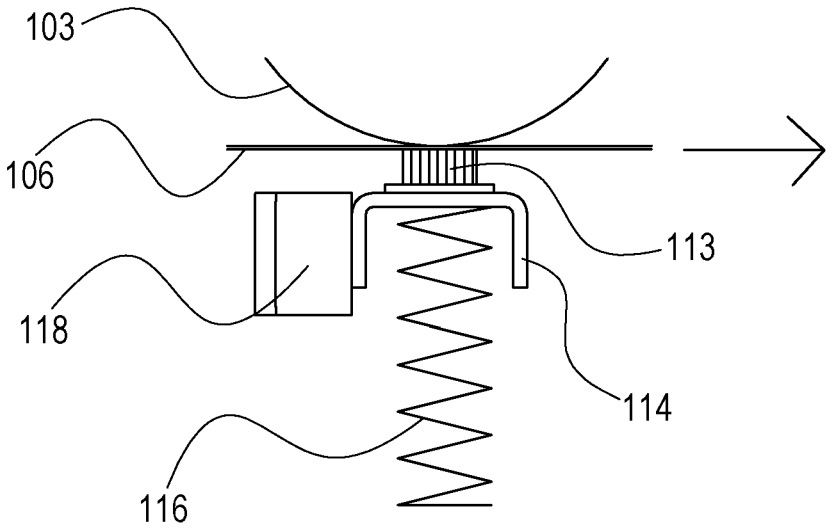
FIG. 5 is a schematic diagram illustrating the relationship between the primary-transfer unit and a photoconductive drum according to the first embodiment.

Now, a configuration of each of the primary-transfer units 112*y*, 112*m*, 112*c*, and 112*k*, as transfer devices, according to the first embodiment will be described. The primary-transfer units 112*y*, 112*m*, 112*c*, and 112*k* are provided for the respective colors and all have the same configuration. Therefore, the suffixes y, m, c, and k in the reference numerals given to associated elements are omitted in the following description. The primary-transfer units 112 are each a transfer device that transfers a toner image from a corresponding one of the photoconductive drums 103 to the intermediate transfer belt 106 (the transfer belt). FIG. 4 is a schematic top view of the primary-transfer unit 112. FIG. 5 is a schematic diagram illustrating the relationship between the primary-transfer unit 112 and the photoconductive drum 103.

As illustrated in FIGS. 4 and 5, the primary-transfer unit 112 includes a transfer member 113 that is in contact with the inner peripheral surface of the intermediate transfer belt 106, and a supporting member 114 that supports the transfer member 113. The transfer member 113 is fixed to the supporting member 114 in such a manner as to be unrotatable with respect to the intermediate transfer belt 106, which is rotatable. The transfer member 113 in such a state is in contact with the intermediate transfer belt 106. Therefore, the transfer member 113 rubs the intermediate transfer belt 106. The primary-transfer unit 112 further includes positioning portions 115, pressing members 116 as compression springs, a contact member 117 as a power feeding unit, and a damping member 118. The positioning portions 115 determine the position of the transfer member 113 with respect to the photoconductive drum 103 in the direction of rotation of the intermediate transfer belt 106.

The transfer member 113 is pressed toward the photoconductive drum 103 by the pressing members 116. Hence, the photoconductive drum 103 and the intermediate transfer belt 106 are closely in contact with each other, and the intermediate transfer belt 106 and the transfer member 113 are closely in contact with each other.

Figure 6A:
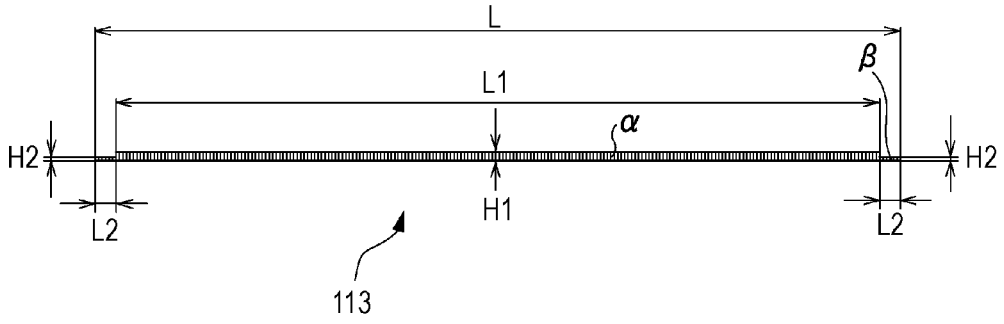
FIG. 6A is a diagram illustrating dimensions of a transfer member in a belt-width direction according to the first embodiment.
Figure 6B:
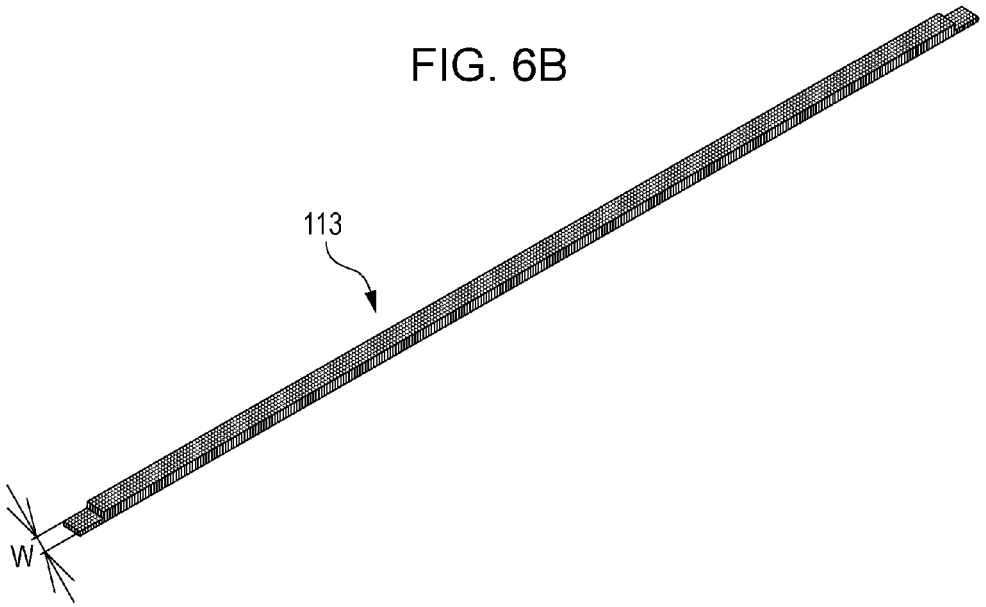
FIG. 6B is a schematic perspective view of the transfer member.

Referring to FIG. 6A, a length L of the transfer member 113 in the long-side direction thereof (a widthwise direction of the intermediate transfer belt 106 that is orthogonal to the direction of rotation of the intermediate transfer belt 106) is 238 mm. Referring to FIG. 6B, a width W of the transfer member 113 in the short-side direction thereof (corresponding to the direction of rotation of the intermediate transfer belt 106) is 4 mm. The transfer member 113 is a brush member that includes a base fabric portion (not illustrated) and a nap portion α. The nap portion α includes a plurality of conductive fibers (for example, conductive nylon fibers) and is fixed to the base fabric portion. The base fabric portion is supported by the supporting member 114. The transfer member 113 is sectioned in the long-side direction thereof, i.e., in the widthwise direction of the intermediate transfer belt 106, into the nap portion α and two welded end parts β.

The nap portion α of the transfer member 113 has a length L1 of 216 mm, and the welded end parts β of the transfer member 113 at the two ends of the nap portion α each have a length L2 of 11 mm.

The nap portion a has a thickness H1 of about 1.5 mm, and the welded end parts β each have a thickness H2 of about 0.5 mm. The nap portion α has elasticity and is in contact with the intermediate transfer belt 106. The transfer member 113 may be made of any of the following materials: conductive urethane foam, an ultrahigh-molecular-weight polyethylene transfer material, and the like; and any combination of the foregoing materials.

Figure 7:
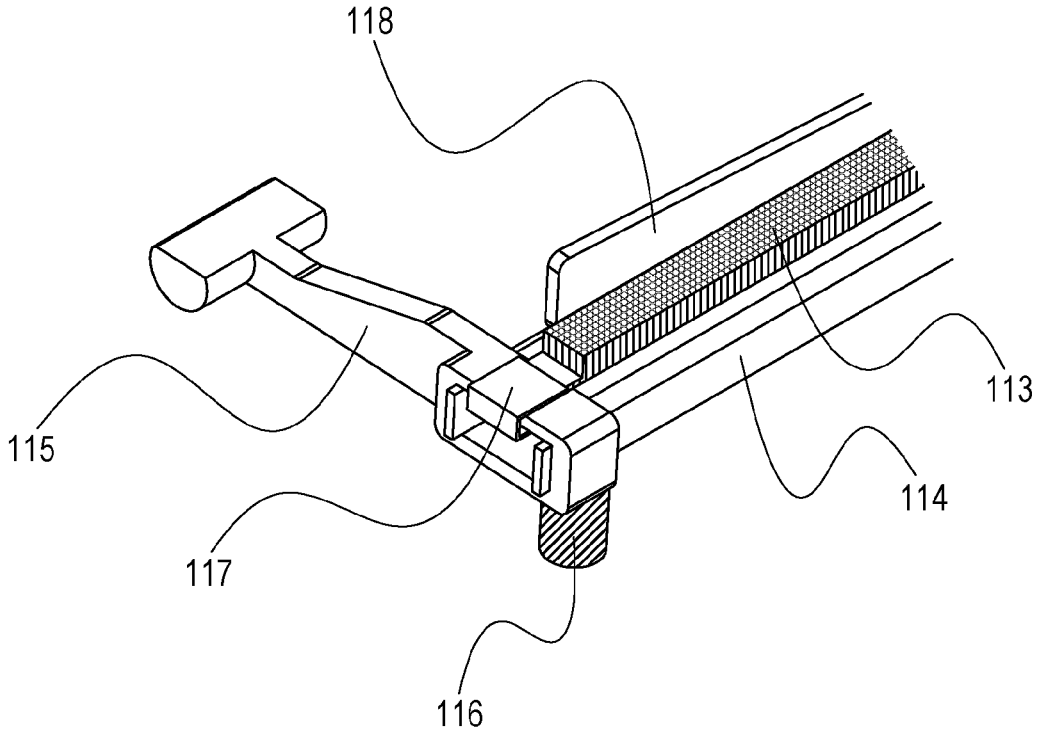
FIG. 7 is a perspective view of one end of the primary-transfer unit according to the first embodiment.
Figure 8:
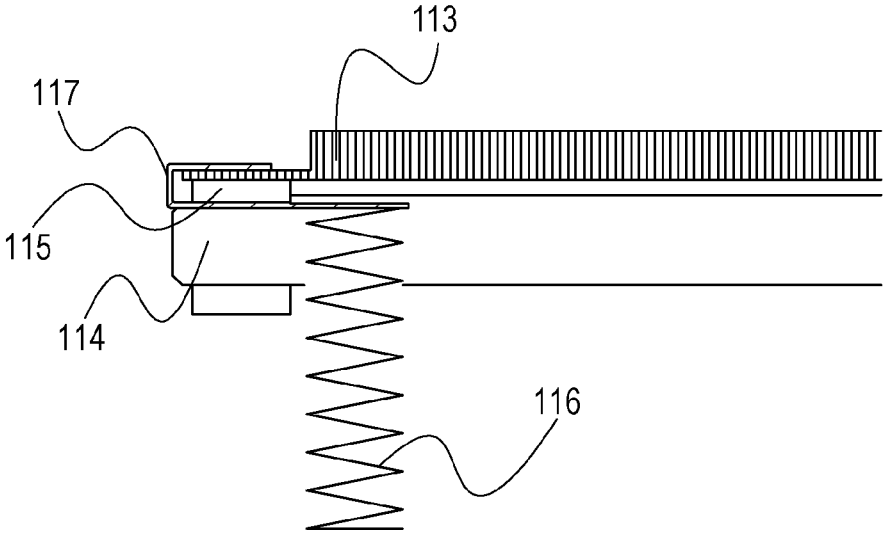
FIG. 8 is a sectional view of the one end of the primary-transfer unit according to the first embodiment.

The transfer member 113 is fixedly attached to the top surface of the supporting member 114 with two-sided adhesive tape (not illustrated) and is thus supported by the supporting member 114. The supporting member 114 is made of a steel plate having a thickness of 0.8 mm and has a rectangular U shape in cross-sectional view. FIG. 7 is a perspective view of one end of the primary-transfer unit 112. FIG. 8 is a sectional view of the one end of the primary-transfer unit 112.

The contact member 117 is a leaf-spring-type member having a rectangular U shape. The positioning portions 115 are each connected to a corresponding one of the two ends of the supporting member 114. The contact member 117 pinches the welded end part β (a part of the transfer member 113) and the positioning portion 115 at the one end of the primary-transfer unit 112. The upper inner surface of the contact member 117 is in contact with the welded end part β of the transfer member 113. The lower outer surface of the contact member 117 is in contact with the pressing member 116 at the one end of the primary-transfer unit 112. The transfer member 113 is pressed by the pressing member 116 with the positioning portion 115 and the supporting member 114 interposed therebetween. The pressing member 116 is a conductive compression spring. The other end of the primary-transfer unit 112 has the same configuration, except the contact member 117, which is provided only at the one end of the primary-transfer unit 112.

Hence, each of the pressing members 116 is electrically connected to the transfer member 113, and a primary-transfer voltage is allowed to be applied from an electrical board (not illustrated) provided on the body of the image forming apparatus 1 to the transfer member 113 through the pressing members 116 and the contact member 117. The supporting member 114 and each of the positioning portions 115 are fixed to each other by light press-fitting. The positioning portions 115 are made of resin and are provided at the two respective ends of the supporting member 114 in the widthwise direction of the intermediate transfer belt 106 (the direction is hereinafter referred to as "the belt-width direction").

Figure 9:
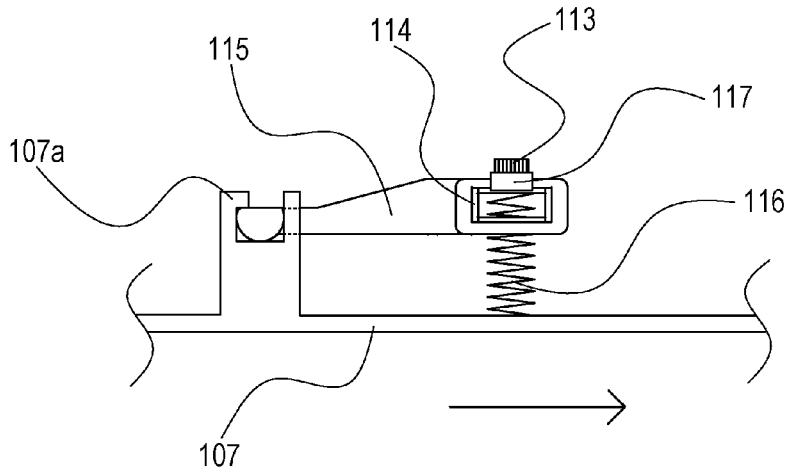
FIG. 9 is a schematic sectional view of the primary-transfer unit that is seen in the axial direction thereof according to the first embodiment.

FIG. 9 is a schematic sectional view of the primary-transfer unit 112 that is seen in the axial direction thereof. As illustrated in FIG. 9, the positioning portions 115 are each in engagement with a supporting portion 107*a* of the unit frame 107, thereby being positioned in the direction of rotation of the intermediate transfer belt 106 (the direction of the arrow illustrated in FIG. 9, the direction is hereinafter referred to as "the direction of belt rotation"). The positioning portion 115 is rotatable about the point of engagement.

Figure 10:
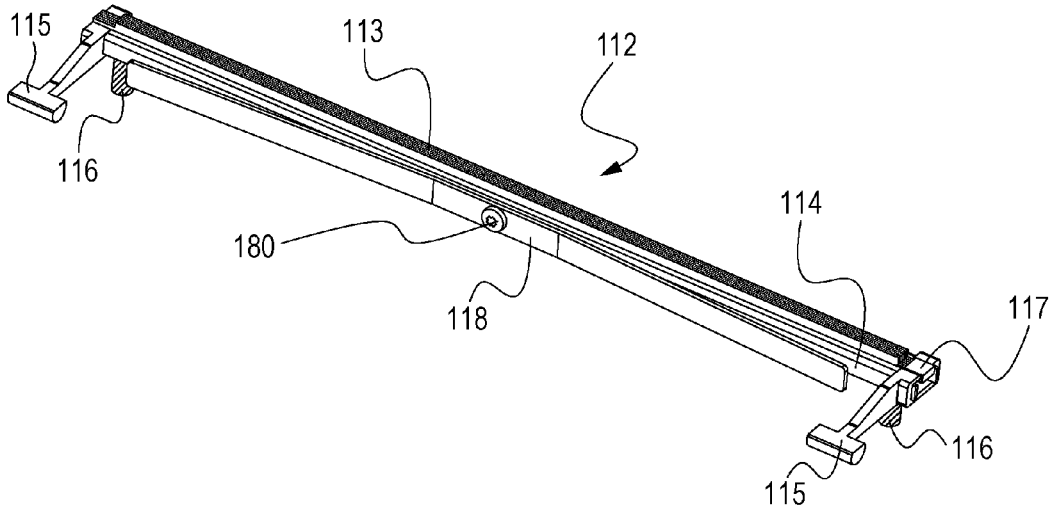
FIG. 10 is a perspective view of the primary-transfer unit that is seen from the downstream side in a direction of belt rotation according to the first embodiment.

FIG. 10 is a perspective view of the primary-transfer unit 112 that is seen from the downstream side in the direction of belt rotation. As illustrated in FIG. 10, the primary-transfer unit 112 includes the damping member 118. The damping member 118 is supported by the supporting member 114. The damping member 118 is made of a steel plate having a thickness of 1.2 mm. The damping member 118 is fastened to a central part, in the belt-width direction, of a side face of the supporting member 114 with a screw 180, thereby being connected to the supporting member 114. It is effective to fasten the damping member 118 to the supporting member 114 at a position where the amount of bend that occurs in the supporting member 114 in the direction of belt rotation is largest (details will be described later). Therefore, the damping member 118 according to the first embodiment is fastened to the above position.

Figure 11A:
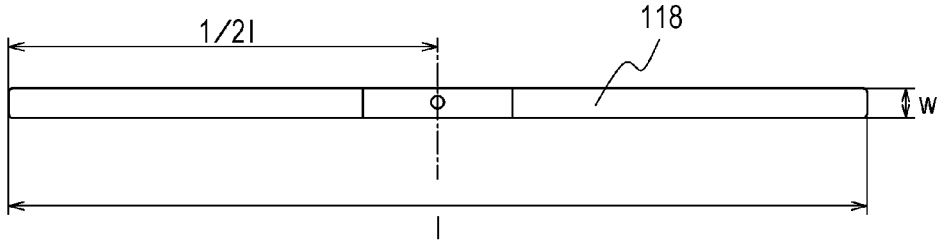
FIG. 11A is a side view of a damping member according to the first embodiment and illustrates dimensions thereof.
Figure 11B:
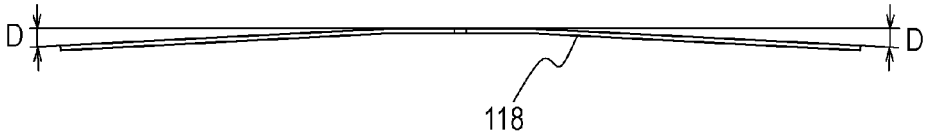
FIG. 11B is a diagram illustrating the angle of the damping member.

FIG. 11A is a side view of the damping member 118 and illustrates the dimensions thereof. FIG. 11B is a diagram illustrating the angle of the damping member 118. The damping member 118 has a length l of 210 mm in the belt-width direction and has a hole for connection to the supporting member 114 at the center thereof in thebelt-width direction. The damping member 118 has a length w of 9 mm in the direction of belt rotation. The two ends of the damping member 118 in the belt-width direction are free ends and are each shifted by an angle D of 3° with respect to the belt-width-direction center of the damping member 118. That is, the damping member 118 has a curved shape that is bent at the belt-width-direction center thereof by a predetermined angle. Hence, the damping member 118 is out of contact with any members including the supporting member 114, except at the center thereof.

Figure 12:
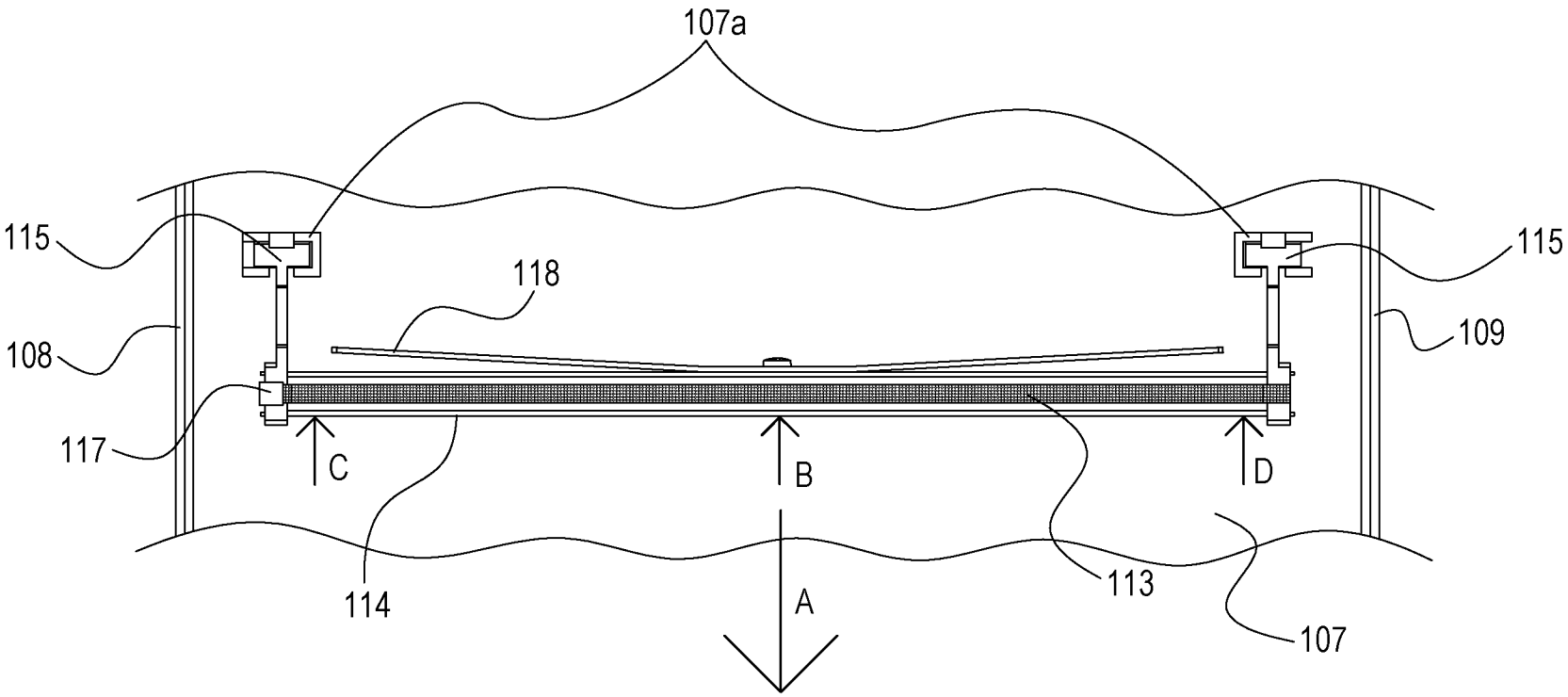
FIG. 12 is another schematic top view of the primary-transfer unit according to the first embodiment.

Now, vibration that occurs in the primary-transfer unit 112 will be described. FIG. 12 is a schematic top view of the primary-transfer unit 112 illustrated for explaining the mechanism of vibration that occurs therein. When the intermediate transfer belt 106 starts to rotate, a frictional force and an electrostatic attractive force that is generated by the application of the transfer voltage to the transfer member 113 act between the transfer member 113 and the intermediate transfer belt 106. The frictional force and the electrostatic attractive force cause the transfer member 113 and the supporting member 114 to bend in a bow-like shape that is convex in the direction of belt rotation (the direction of the arrow A in FIG. 12), with the positioning portions 115 at the two ends serving as fixed ends.

In this state, the supporting member 114 exerts a restoring force with its own stiffness. Then, the moment the restoring force exceeds the resultant of the frictional force and the attractive force, a slip occurs between the transfer member 113 and the intermediate transfer belt 106. Consequently, the supporting member 114 returns to its initial position. With repetitions of the above motion, the supporting member 114 vibrates by being repeatedly bent in a bow-like shape, and the vibration generates noise.

To avoid such a situation, the first embodiment features the damping member 118 attached to the primary-transfer unit 112. When the primary-transfer unit 112 vibrates by being repeatedly bent in a bow-like shape, the vibration is transmitted from the supporting member 114 to the damping member 118. Then, the two free ends of the damping member 118 vibrate and consume some kinetic energy. Consequently, the amplitude of vibration of the supporting member 114 is suppressed to be small, and damage to associated members and noise generation caused by the vibration are suppressed more than in the related-art apparatus. Note that there is a delay in the vibration of the damping member 118 with respect to the vibration of the supporting member 114, and the damping member 118 therefore vibrates with a phase different from that of the supporting member 114.

Figure 13A:
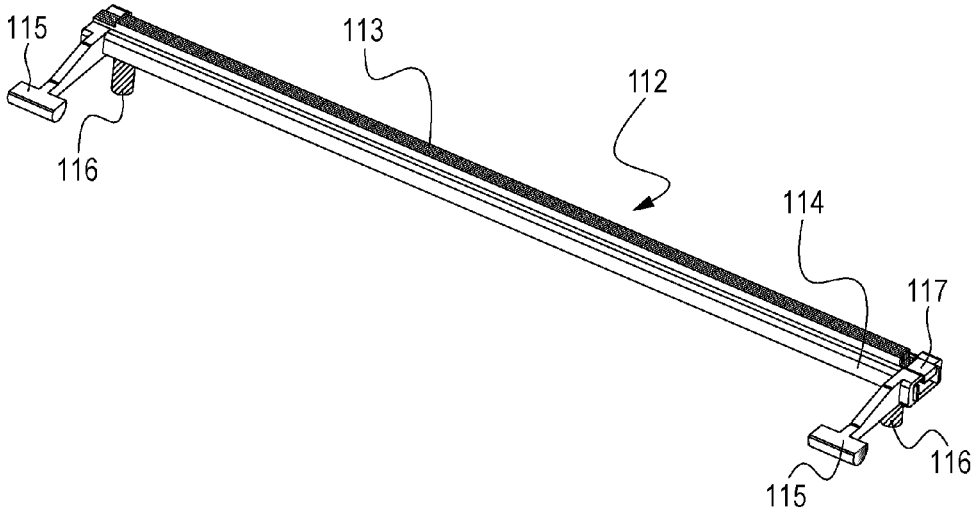
FIG. 13A is a perspective view of a primary-transfer unit according to a first comparative example.
Figure 13B:
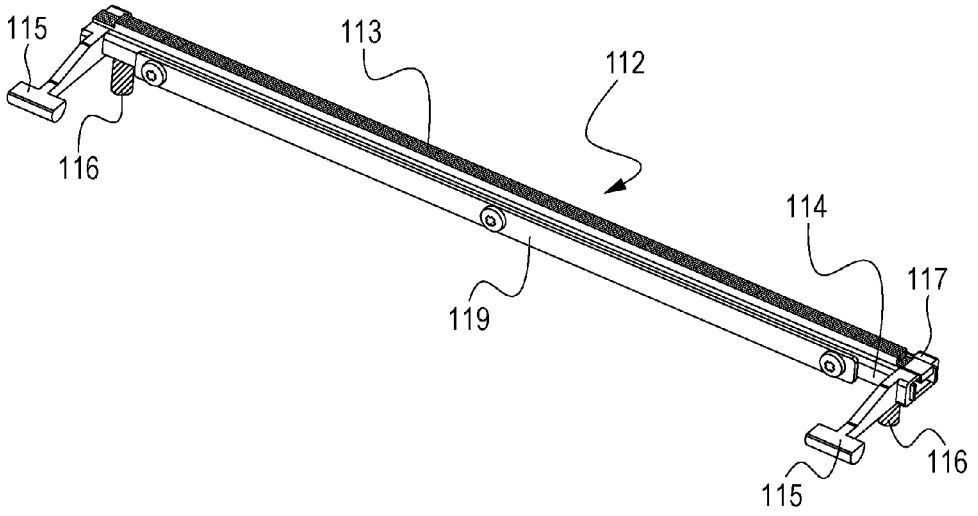
FIG. 13B is a perspective view of a primary-transfer unit according to a second comparative example.

To demonstrate the above advantageous effect produced by the first embodiment, some comparative examples will now be described. FIG. 13A is a perspective view of a primary-transfer unit 112 according to a first comparative example in which no damping member is provided. FIG. 13B is a perspective view of a primary-transfer unit 112 according to a second comparative example in which the damping member 118 is replaced with a reinforcing member 119. The reinforcing member 119 is fastened to the supporting member 114 at three points (the center and the two ends) in the belt-width direction with screws.

An experiment was conducted in which values of the acceleration of the supporting member 114 in the direction of belt rotation when the intermediate transfer belt 106 was rotated while the transfer voltage was applied to the transfer member 113 were compared among the three primary-transfer units 112. The acceleration was measured at the three points of the supporting member 114 in total in the belt-width direction: specifically, as indicated in FIG. 12, a point B at the center and points C and D at the two ends, with an ultra-compact single-axial accelerometer NP-2016 of ONO SOKKI CO., LTD.

Figure 14:
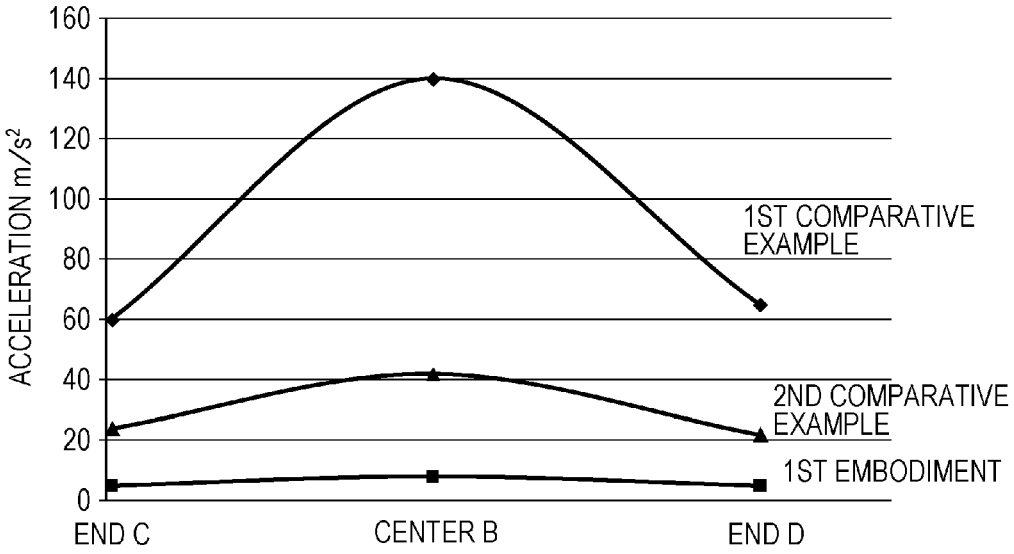
FIG. 14 is a graph given for comparison of acceleration among the first embodiment, the first comparative example, and the second comparative example.

FIG. 14 is a graph illustrating the results of the experiment. The vertical axis represents the acceleration in the direction of belt rotation. The horizontal axis represents the position of the supporting member 114 in the belt-width direction. In the first embodiment, the acceleration was 5 $m/s^2$ at each of the two ends C and D and 8 $m/s^2$ at the center B. In the first comparative example, the acceleration was 60 to 65 $m/s^2$ at each of the two ends C and D and 140 $m/s^2$ at the center B. In the second comparative example, the acceleration was 22 to 24 $m/s^2$ at each of the two ends C and D and 42 $m/s^2$ at the center B.

Comparing the three cases at the center B, the acceleration measured in the first embodiment is lower by about 94% than that measured in the first comparative example and by about 80% than that measured in the second comparative example. Comparing the three cases at the ends C and D, the acceleration measured in the first embodiment is lower by about 92% than that measured in the first comparative example and by about 77% than that measured in the second comparative example.

The above results show that the effect of vibration damping is enhanced by employing the damping member 118 having free ends. In the second comparative example, the reinforcing member 119 needs to have a large mass and a large size so as to damp the vibration.

Consequently, the size of the primary-transfer unit 112 increases. Furthermore, in the second comparative example, the reinforcing member 119 is not deformable and withstands the vibration. Therefore, if a certain stress is applied to the reinforcing member 119 repeatedly, the reinforcing member 119 may suffer from fatigue and may be damaged. In contrast, the damping member 118 according to the first embodiment is bendable by having the two free ends and thus consumes some kinetic energy. Therefore, the occurrence of damage to the damping member 118 after repeated application of a certain stress thereto is suppressed.

Hence, in the first embodiment employing the damping member 118, the primary-transfer unit 112 can have a light and simple configuration while the vibration of the primary-transfer unit 112 is damped.

Furthermore, since the damping member 118 is made of sheet metal and the thicknesswise direction thereof corresponds to the direction of vibration, air resistance that occurs when the damping member 118 vibrates increases the effect of vibration damping. While the first embodiment concerns a case where the damping member 118 is made of sheet metal, the damping member 118 is not limited to be made of sheet metal and may be made of, for example, a plastic plate with weights attached to the free ends of the plate.

Moreover, the damping member 118 may be formed of a plurality of members. For example, the damping member 118 may be divided into two members, with one end of each of the two members that is nearer to the belt-width-direction center of the damping member 118 being fastened to the supporting member 114 and with the other end of each of the two members being a free end.

Figure 15:
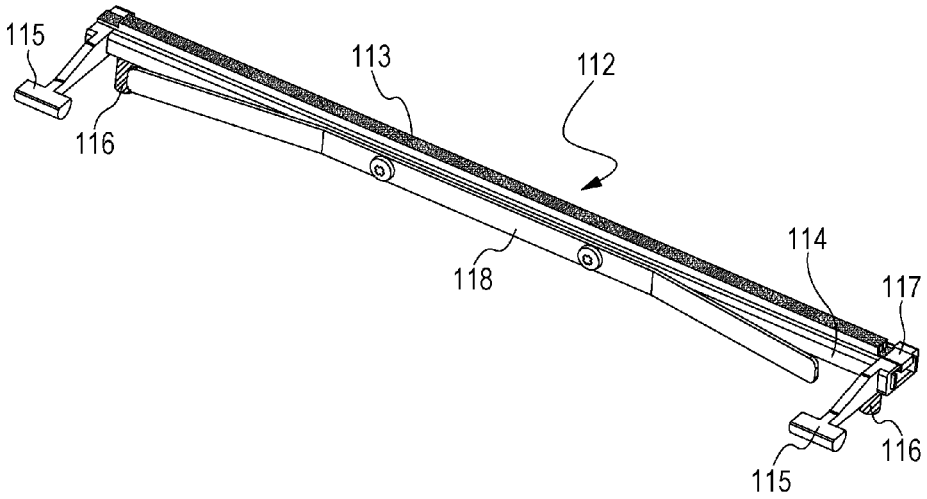
FIG. 15 is a schematic diagram of a primary-transfer unit according to a first modification of the first embodiment.
Figure 16:
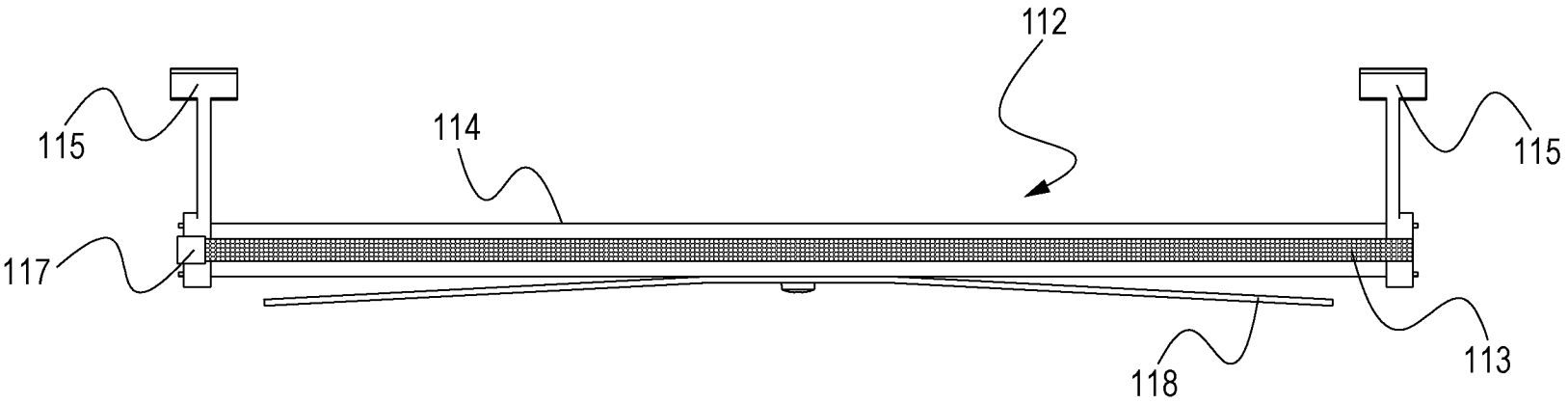
FIG. 16 is a schematic diagram of a primary-transfer unit according to a second modification of the first embodiment.

The damping member 118 is not limited to a member that is fastened only at the belt-width-direction center thereof. For example, FIG. 15 illustrates a modification of the primary-transfer unit 112 according to the first embodiment, in which the damping member 118 is fastened in a different manner. The primary-transfer unit 112 illustrated in FIG. 15 differs from the primary-transfer unit 112 illustrated in FIG. 10 in that the damping member 118 is fastened to the supporting member 114 at two belt-width-direction points thereof with two screws, respectively. Yet, the two belt-width-direction ends of the damping member 118 of the primary-transfer unit 112 illustrated in FIG. 15 are free ends. Therefore, the damping member 118 illustrated in FIG. 15 can also damp the vibration of the primary-transfer unit 112. Alternatively, referring to FIG. 16, the damping member 118 may be provided on the downstream side of the supporting member 114 in the direction of belt rotation.

Figure 17A:
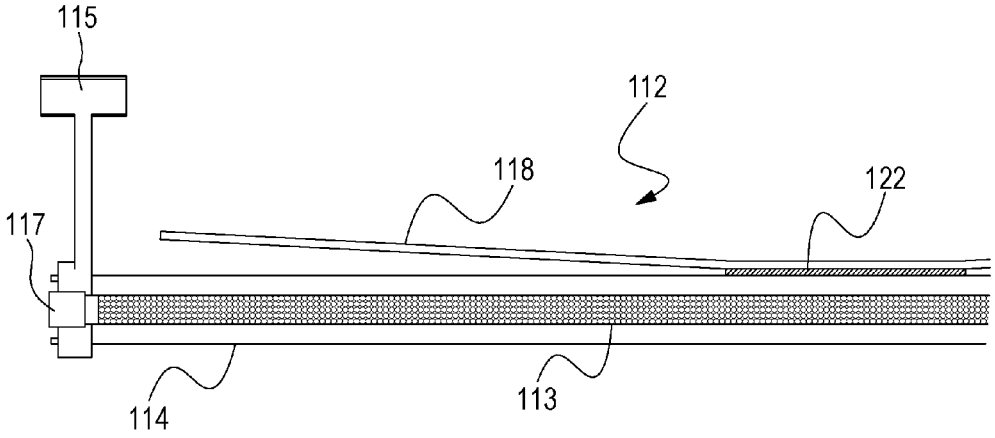
FIGS. 17A and 17B are schematic diagrams of primary-transfer units according to third and fourth modifications, respectively, of the first embodiment.

Alternatively, referring to FIG. 17A, the damping member 118 may be attached to the supporting member 114 with a viscoelastic member 122 such as two-sided adhesive tape, instead of being fastened with a screw or the like. In such a configuration, while the damping member 118 as a whole vibrates with a phase different from that of the vibration of the supporting member 114, the free ends at the two ends of the damping member 118 each vibrate with a phase yet different from that of the overall vibration of the damping member 118. Therefore, the vibration of the primary-transfer unit 112 can be damped more effectively.

Figure 17B:
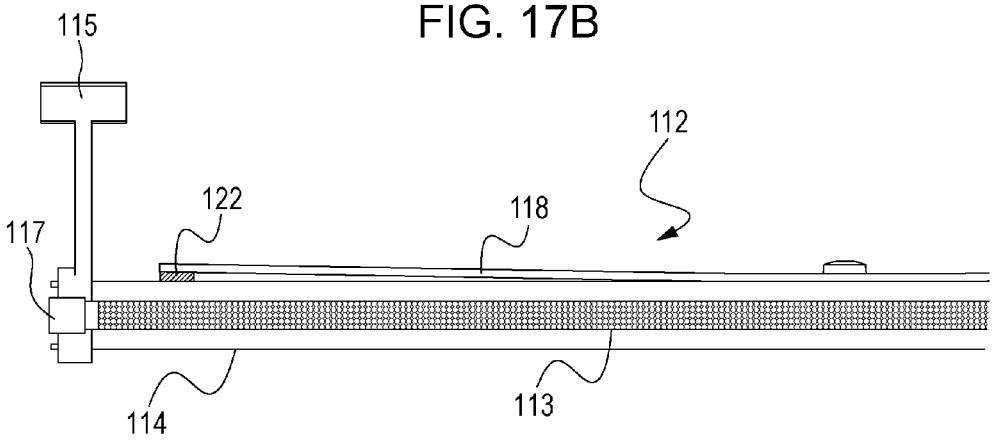
Figure 18A:
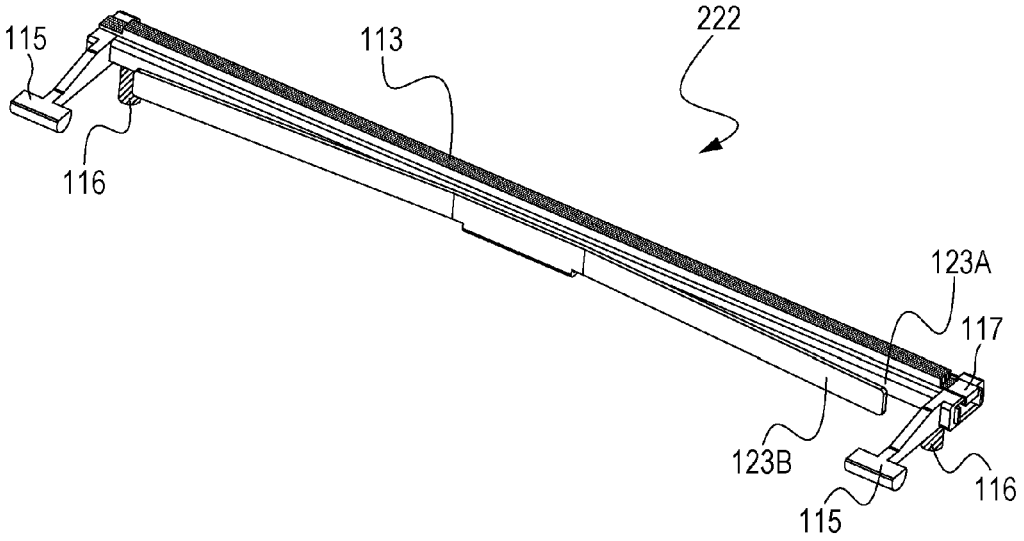
FIGS. 18A and 18B are schematic diagrams of a primary-transfer unit according to a fifth modification of the first embodiment.
Figure 18B:
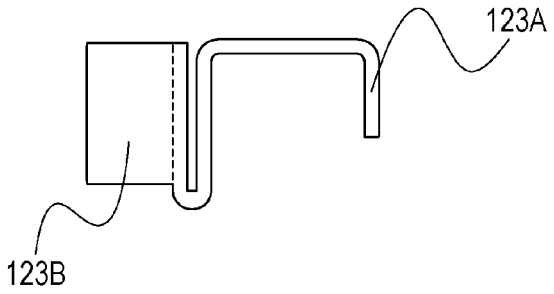

Alternatively, referring to FIG. 17B, the two ends of the damping member 118 may each be attached to the supporting member 114 with the viscoelastic member 122 such as two-sided adhesive tape. Alternatively, the damping member 118 and the supporting member 114 may be integrated into a single unit. FIG. 18A illustrates a primary-transfer unit 222 according to another modification of the first embodiment. FIG. 18B is a sectional view of the primary-transfer unit 222. The primary-transfer unit 222 includes a damping portion 123B and a supporting portion 123A that are integrated into a single unit. If the damping portion 123B has free ends, the damping portion 123B produces the same advantageous effect as that produced by the primary-transfer unit 112.

Figure 20:
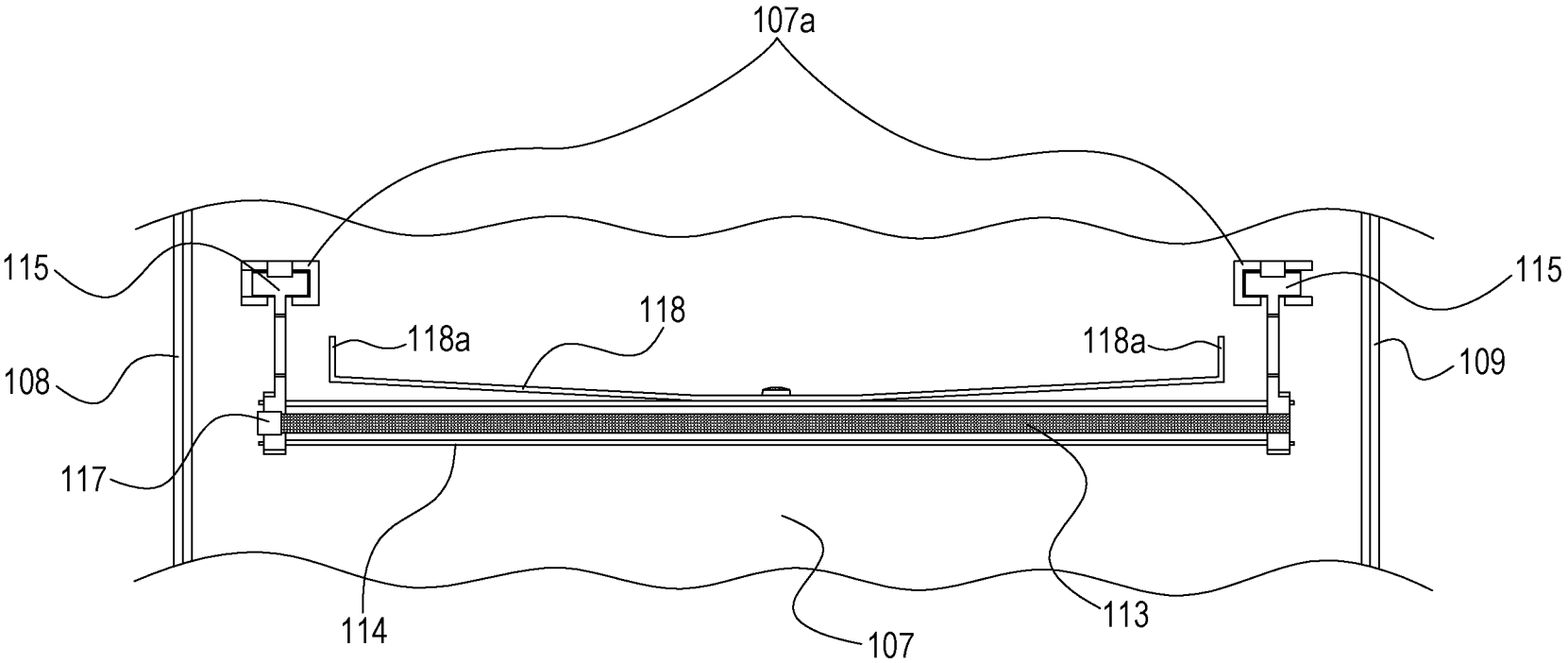
FIG. 20 is a schematic diagram of a primary-transfer unit according to a sixth modification of the first embodiment.

FIG. 20 illustrates a yet another modification of the primary-transfer unit 112. The damping member 118 illustrated in FIG. 20 includes folded parts 118*a* at two respective ends thereof. Since the damping member 118 includes the folded parts 118*a*, the natural frequency of the primary-transfer unit 112 is adjusted by the weight of the folded parts 118*a* even if there is not enough space in the belt-width direction.

Second Embodiment

In the first embodiment, the transfer member 113 that is in contact with the inner peripheral surface of the intermediate transfer belt 106 is employed as a rubbing member, and the damping member 118 is fastened to the supporting member 114 that supports the transfer member 113. In a second embodiment of the present invention, a damping member 133 is fastened to a supporting member 132 that supports a charging brush 131. The charging brush 131 corresponds to a rubbing member and is provided in contact with the outer peripheral surface of the intermediate transfer belt 106. The other elements of the second embodiment are the same as those of the first embodiment, and such elements are denoted by corresponding ones of the reference numerals used in the first embodiment.

Figure 19A:
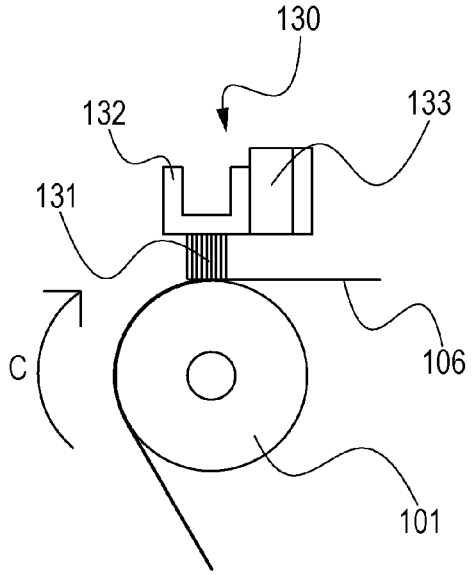
FIGS. 19A and 19B are schematic diagrams of a charging unit according to a second embodiment of the present invention.
Figure 19B:
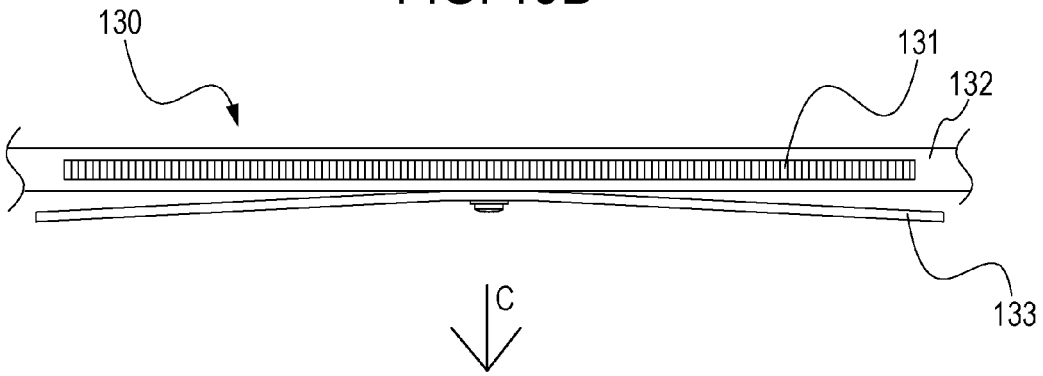

FIG. 19A is a schematic diagram of a toner charging unit 130 according to the second embodiment. FIG. 19B is a schematic top view of the toner charging unit 130. The toner charging unit 130 includes the charging brush 131 that is in contact with and thus rubs the outer peripheral surface of the intermediate transfer belt 106, the supporting member 132 that supports the charging brush 131, and the damping member 133 that is fastened to the supporting member 132. When a charging voltage is applied to the charging brush 131, residual toner particles on the intermediate transfer belt 106 are charged. The supporting member 132 is made of a steel plate and has a rectangular U shape in cross-sectional view. The charging brush 131 is fixedly attached to the bottom surface of the supporting member 132 with two-sided adhesive tape (not illustrated) and is thus supported by the supporting member 132. The charging brush 131 is a rubbing member that keeps in contact with the intermediate transfer belt 106 in such a manner as to be unrotatable with respect to the supporting member 132.

The charging brush 131 is provided across the intermediate transfer belt 106 from the secondary-transfer counter roller 101 and is in contact with the outer peripheral surface of the intermediate transfer belt 106 over the entirety in the belt-width direction. The supporting member 132 is fastened to the transfer unit or a body frame (not illustrated) at the two belt-width-direction ends thereof with screws or the like and is thus positioned. As illustrated in FIGS. 19A and 19B, the damping member 133, which is made of a steel plate or the like, is fastened to the belt-width-direction center of a side face of the supporting member 132 with a screw or the like.

As with the case of the first embodiment, the damping member 133 needs to be fastened at a position where the amplitude of vibration of the supporting member 132 in the direction of belt rotation is substantially largest. Hence, in the second embodiment, the damping member 133 is fastened at the above position. Furthermore, the two belt-width-direction ends of the damping member 133 are free ends and are out of contact with any components including the supporting member 132.

In such a configuration, when the intermediate transfer belt 106 rotates in a direction C, the resultant of the frictional force and the attractive force that occur between the intermediate transfer belt 106 and the charging brush 131 and the restoring force of the supporting member 132 pull each other, whereby the toner charging unit 130 vibrates in the direction C by being repeatedly bent in a bow-like shape. However, the vibration is transmitted to the damping member 133. Therefore, the two ends of the damping member 133 vibrate in the same direction as the vibration of the supporting member 132 and consume some kinetic energy. Consequently, the amplitude of vibration of the supporting member 132 is suppressed to be small. Thus, the occurrence of damage to any members and the generation of noise due to the vibration are suppressed more than in the related-art apparatus.

While the first and second embodiments each concern an image forming apparatus including the intermediate transfer belt 106 as a transfer belt, the transfer belt is not limited to the intermediate transfer belt 106 and may be a conveying belt that bears and conveys a transfer material.

While the first and second embodiments each concern a case where the transfer belt is an endless rotating member that is rubbed by a rubbing member, the transfer belt may be any other member. For example, a photoconductive belt may be employed as an endless rotating member, and the outer peripheral surface of the photoconductive belt may be provided in contact with and rubbed by a charging brush (a rubbing member) supported by a supporting member to which a damping member is fastened. Employing a damping member having free ends damps the vibration of the rubbing member that rubs the photoconductive belt.

Third Embodiment

Figure 21:
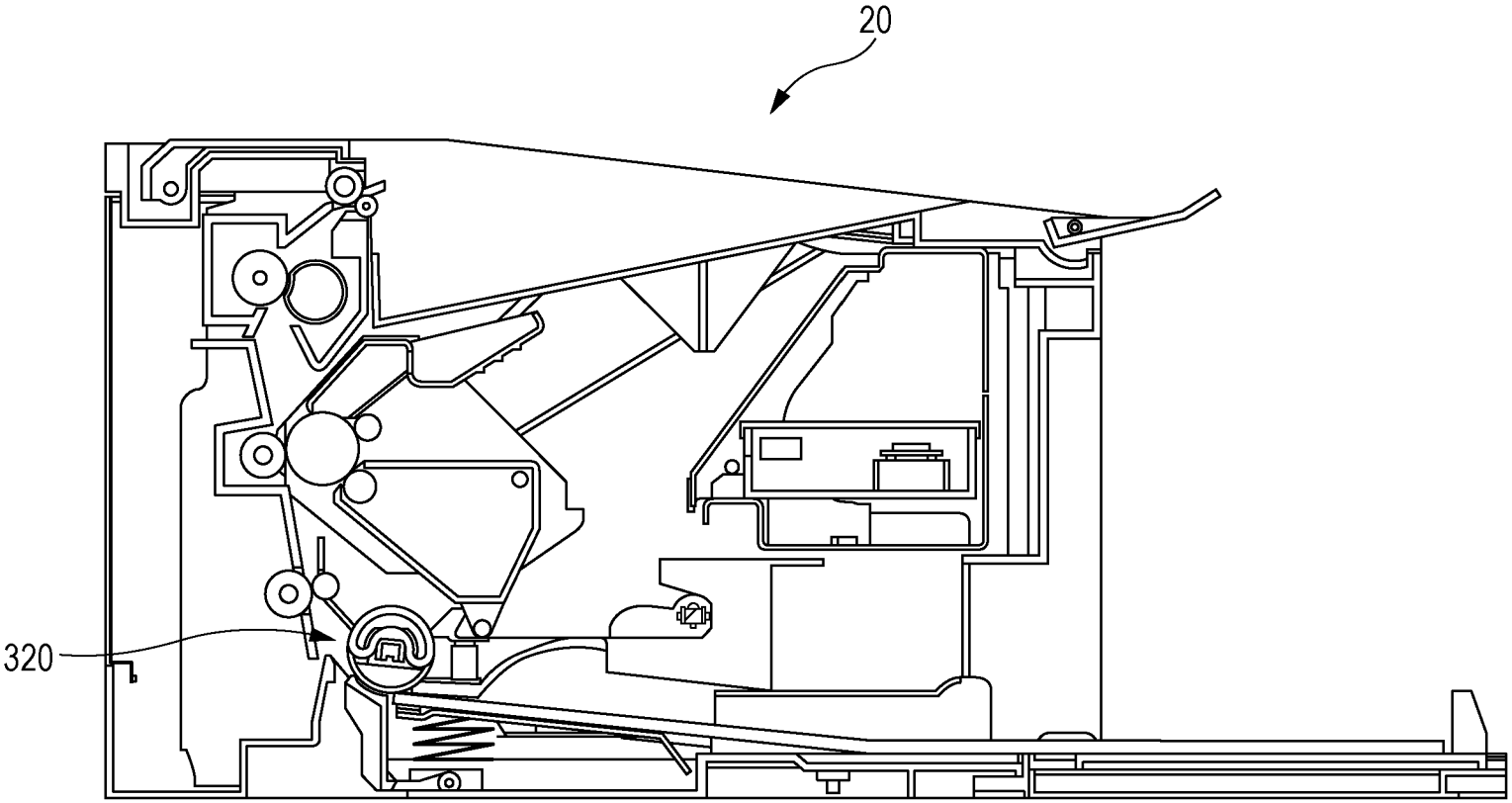
FIG. 21 is a schematic diagram of a sheet feeding mechanism according to a third embodiment of the present invention.

In the first embodiment, the transfer member 113 that is in contact with the inner peripheral surface of the intermediate transfer belt 106 is employed as a rubbing member, and the damping member 118 is fastened to the supporting member 114 that supports the transfer member 113. In a third embodiment of the present invention, a damping member is attached to a supporting member that supports a separating pad serving as a rubbing member that rubs a transfer material that is moved in an image forming operation. Referring to FIG. 21, an image forming apparatus according to the third embodiment is a typical monochrome laser-beam printer 20, detailed description of which is omitted herein. In the monochrome laser-beam printer 20, a transfer material S, such as a sheet, in a sheet cassette is fed to an image forming section by a sheet feeding mechanism 320. The sheet feeding mechanism 320 is a rubbing unit that includes a rubbing member. In the image forming section, a toner image formed on a photoconductive drum is primarily transferred to the transfer material S, and the toner image on the transfer material S is fixed by a fixing device. The transfer material S having the fixed toner image is then discharged to the outside of the printer 20.

Figure 22:
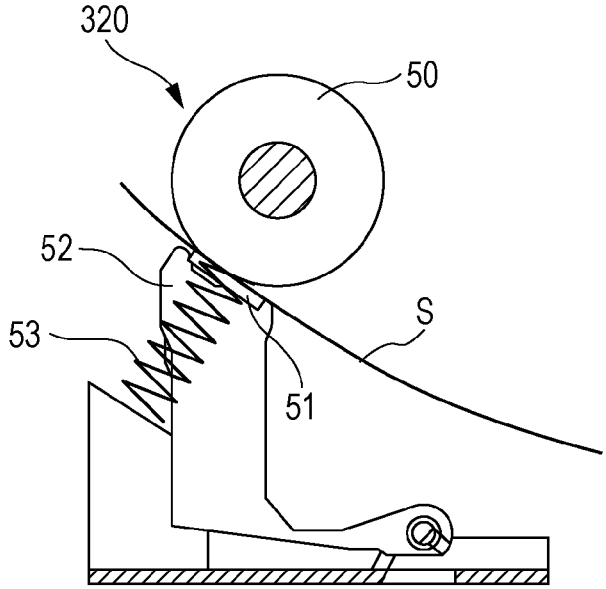
FIG. 22 is a sectional view of the sheet feeding mechanism.

FIG. 22 is a sectional view of the sheet feeding mechanism 320 according to the third embodiment.

When a feed roller 50 receives a driving force from a drive source (not illustrated), the feed roller 50 rotates while being in contact with the transfer material S. The transfer material S that is in contact with the feed roller 50 is conveyed toward the image forming section by the feed roller 50. In this process, a subsequent transfer material S (not illustrated) comes into contact with a separating pad 51, whereby the preceding transfer material S is separated from the subsequent transfer material S and is conveyed while being rubbed by the separating pad 51. The separating pad 51 is supported by a supporting member 52 and is urged toward the feed roller 50 by a spring 53. In this case, the separating pad 51 serves as a rubbing member that rubs the transfer material S (a moving member) that is moved, and the separating pad 51 is vibrated by the rubbing of the transfer material S, as with the transfer member 113 of the first embodiment. Consequently, the supporting member 52 that supports the separating pad 51 also vibrates, as with the supporting member 114 of the first embodiment.

Hence, in the third embodiment, a damping member 54 (see FIG. 23) is fastened to the supporting member 52, whereby the vibration of the separating pad 51 is damped, as with the case of the first embodiment.

Figure 23:
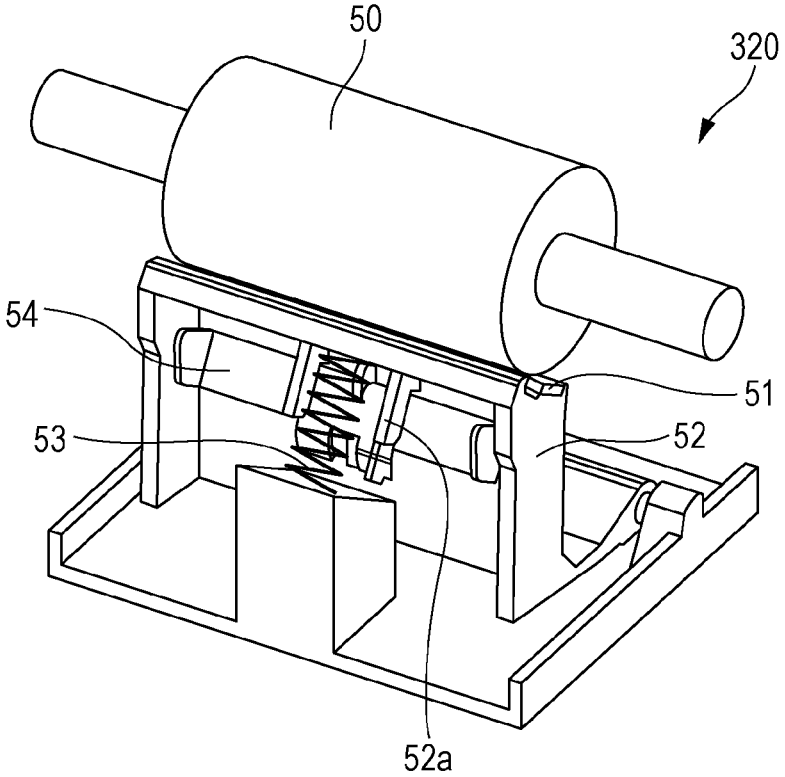
FIG. 23 is a perspective view of the sheet feeding mechanism.

FIG. 23 is a perspective view of the sheet feeding mechanism 320. The separating pad 51 is provided at a position facing the feed roller 50, and the separating pad 51 is in contact with the feed roller 50 over the entirety in the belt-width direction that is orthogonal to the direction of conveyance of the transfer material S. The separating pad 51 is supported by the supporting member 52. The supporting member 52 includes a fastening portion 52*a*. The damping member 54 is fastened to the fastening portion 52*a*. The two belt-width-direction ends of the damping member 54 are positioned within an area where the feed roller 50 is in contact with the transfer material S.

The damping member 54 is not fixed excluding at the position where the damping member 54 is fastened to the fastening portion 52*a*. That is, the damping member 54 has free ends as with the damping member 118 of the first embodiment. Thus, the effect of damping is enhanced. As with the case of the first embodiment, employing the damping member 54 damps the vibration of the separating pad 51 and reduces the weight and the complexity of the sheet feeding mechanism 320.

Furthermore, since the damping member 54 is made of sheet metal and its thicknesswise direction corresponds to the direction of vibration, air resistance that occurs when the damping member 54 vibrates enhances the effect of damping. While the third embodiment concerns a case where the damping member 54 is made of sheet metal, the damping member 54 is not limited to be made of sheet metal and may alternatively be made of, for example, a plastic plate with weights attached to the free ends of the plate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-109182, filed May 28, 2015, which is hereby incorporated by reference herein in its entirety.

What is claimed is:

1. An image forming apparatus comprising:

an image bearing member configured to bear a toner image;

a rotatable transfer belt to which the toner image on the image bearing member is transferred to a transfer material; and a transfer device provided in contact with the transfer belt and configured to transfer the toner image from the image bearing member to the transfer belt, wherein the transfer device includes a rubbing member provided in contact with the transfer belt;

a supporting member supporting the rubbing member, a pressing member configured to press the supporting member so as to press the rubbing member toward the image bearing member; and a damping member configured to damp vibration of the transfer device, and wherein the damping member is fastened to the supporting member, and an end of the damping member in a width direction that is orthogonal to a direction of rotation of the transfer belt is a free end.

2. The image forming apparatus according to claim 1, wherein two ends of the damping member in the width direction are free ends.

3. The image forming apparatus according to claim 2, wherein the rubbing member is in contact with an inner peripheral surface of the transfer belt in such a manner as to be unrotatable with respect to the supporting member.

4. The image forming apparatus according to claim 2, wherein the rubbing member is a brush member that includes a base fabric portion supported by the supporting member; and a plurality of conductive fibers fixed to the base fabric portion.

5. The image forming apparatus according to claim 4, wherein the transfer device includes a power feeding unit configured to apply a transfer voltage to the plurality of conductive fibers, and wherein the power feeding unit pinches a part of the supporting member and a part of the rubbing member.

6. The image forming apparatus according to claim 2, wherein the damping member is fastened to the supporting member at a position in the width direction where an amount of bend in the supporting member in the direction of rotation of the transfer belt is largest.

7. The image forming apparatus according to claim 6, wherein the position where the damping member is fastened to the supporting member is a center of the damping member in the width direction.

8. The image forming apparatus according to claim 2, wherein the transfer device includes a positioning portion configured to position the rubbing member with respect to the image bearing member in the direction of rotation of the transfer belt, and wherein the positioning portion is connected to the supporting member.

9. The image forming apparatus according to claim 2, wherein the transfer device includes a pressing member configured to press the rubbing member against the image bearing member with the transfer belt and the supporting member interposed between the rubbing member and the image bearing member.

10. The image forming apparatus according to claim 2, wherein the damping member has a curved shape that is bent at a width-direction center such that the two free ends each being shifted by a predetermined angle with respect to the width-direction center.

11. The image forming apparatus according to claim 2, wherein the damping member includes folded parts at the respective free ends.

12. The image forming apparatus according to claim 2, wherein the damping member is made of sheet metal.

13. The image forming apparatus according to claim 2, wherein the damping member is fastened to the supporting member with a screw.

14. The image forming apparatus according to claim 2, wherein the damping member is fastened to the supporting member with two-sided adhesive tape.

15. The image forming apparatus according to claim 2, wherein the damping member is fastened to the supporting member at a position on an upstream side of the supporting member in the direction of rotation of the transfer belt.

16. The image forming apparatus according to claim 2, wherein the transfer belt is an intermediate transfer belt to which the toner image is primarily transferred from the image bearing member.

17. The image forming apparatus according to claim 2, wherein the transfer belt is a conveying belt that conveys a transfer material to which the toner image is transferred from the image bearing member.

18. An image forming apparatus comprising:

a rubbing unit that includes a rubbing member, provided in contact with a moving member that is moved, configured to rub the moving member;

a supporting member supporting the rubbing member; and a damping member configured to damp vibration of the rubbing member, wherein a central part of the damping member in a width direction that is orthogonal to a direction of movement of the moving member is fastened to the supporting member, and two ends of the damping member in the width direction are free ends.

19. The image forming apparatus according to claim 18, wherein the rubbing unit includes a separating pad as the rubbing member, wherein the separating pad faces a feed roller configured to feed a sheet while being in contact with the sheet, and wherein the separating pad rubs the sheet, the sheet being the moving member.

20. The image forming apparatus according to claim 19, wherein the two ends of the damping member in the width direction are positioned within an area where the feed roller is in contact with the sheet.

* * * * *